US011230748B2

(12) United States Patent
Code et al.

(10) Patent No.: US 11,230,748 B2
(45) Date of Patent: Jan. 25, 2022

(54) METHOD AND SECTION FOR QUICK COOLING OF A CONTINUOUS LINE FOR TREATING METAL BELTS

(71) Applicant: FIVES STEIN, Maisons Alfort (FR)

(72) Inventors: Florent Code, Maisons Alfort (FR); Eric Magadoux, Maisons Alfort (FR); Miroslav Raudenski, Brno (CZ); Jaroslav Horski, Brno (CZ)

(73) Assignee: FIVES STEIN, Maisons-Alfort (FR)

( * ) Notice: Subject to any disclaimer, the term of this patent is extended or adjusted under 35 U.S.C. 154(b) by 154 days.

(21) Appl. No.: 16/468,847

(22) PCT Filed: Dec. 8, 2017

(86) PCT No.: PCT/EP2017/082073
§ 371 (c)(1),
(2) Date: Jun. 12, 2019

(87) PCT Pub. No.: WO2018/108747
PCT Pub. Date: Jun. 21, 2018

(65) Prior Publication Data

US 2020/0071788 A1 Mar. 5, 2020

(30) Foreign Application Priority Data

Dec. 14, 2016 (FR) ..... 1662421

(51) Int. Cl.
*C21D 9/52* (2006.01)
*C21D 1/667* (2006.01)
*C21D 1/60* (2006.01)

(52) U.S. Cl.
CPC ..... *C21D 9/52* (2013.01); *C21D 1/60* (2013.01); *C21D 1/667* (2013.01)

(58) Field of Classification Search
CPC . C21D 1/60; C21D 1/667; C21D 9/52; C21D 9/573
USPC ..... 266/46, 102, 111, 113
See application file for complete search history.

(56) References Cited

U.S. PATENT DOCUMENTS 3,300,198 A * 1/1967 Clumpner ..... C21D 9/573 134/64 R
4,065,252 A * 12/1977 Hemsath ..... C21D 1/667 432/77
4,407,487 A * 10/1983 Wang ..... B05B 7/0884 239/428.5

(Continued)

FOREIGN PATENT DOCUMENTS

EP 1 634 657 A1 3/2006
JP S60184635 A 9/1985
JP S61153236 A 7/1986

OTHER PUBLICATIONS

International Search Report from PCT/EP2017/082073, dated Mar. 4, 2018, pp. 1-6.

*Primary Examiner* — Jessee R Roe
*Assistant Examiner* — Michael Aboagye
(74) *Attorney, Agent, or Firm* — The Belles Group, P.C.

(57) ABSTRACT

Rapid cooling section of a continuous metal strip treatment line, where the strip is cooled with a spray of liquid or a mixture of gas and liquid using nozzles located on each side of the strip. Along the direction of movement of the strip, it includes at least one row of flat spray nozzles across the strip followed by at least one row of cone spray nozzles across the strip.

12 Claims, 3 Drawing Sheets

(56) References Cited

U.S. PATENT DOCUMENTS

| | | | | |
|---|---|---|---|---|
| 5,640,872 | A * | 6/1997 | Plata | B05B 7/0861 72/201 |
| 7,582,251 | B2 * | 9/2009 | Ebner | B21B 45/0218 266/113 |
| 7,968,046 | B2 * | 6/2011 | Ebner | C21D 9/00 266/259 |
| 8,012,406 | B2 * | 9/2011 | Yamamoto | B21B 45/0233 266/46 |
| 2012/0068391 | A1 * | 3/2012 | Eto | B21B 45/0218 266/44 |

* cited by examiner

METHOD AND SECTION FOR QUICK COOLING OF A CONTINUOUS LINE FOR TREATING METAL BELTS

CROSS-REFERENCE TO RELATED PATENT APPLICATIONS

The present application is a U.S. national stage application under 35 U.S.C. § 371 of PCT Application No. PCT/EP2017/082073, filed Dec. 8, 2017, which claims priority to French Patent Application No. 16/62421, filed Dec. 14, 2016. The disclosures of the aforementioned priority applications are incorporated herein by reference in their entireties.

BRIEF SUMMARY OF THE INVENTION

The invention relates to continuous production lines for metal strips. More specifically, it concerns rapid cooling sections of annealing or galvanizing lines for steel strips, where the strip is cooled at a speed between 400° C./s and 1200° C./s.

The strip typically enters these cooling sections at a temperature around 800° C., and exits at a temperature close to ambient or at an intermediate temperature. This cooling stage is vital to obtain the desired metallurgical and mechanical properties. To obtain steels with superior mechanical properties whilst reducing the use of alloying elements, notably to reduce the cost of the steels, very fast cooling speeds are required, at around 1000° C./s. These speeds are particularly necessary at high temperatures to form martensite, particularly when the strip is between approximately 800 and 500° C. Due to the so-called Leidenfrost effect, at this temperature range it is particularly difficult to reach high cooling rate during water cooling. The so-called Leidenfrost effect is when a thin layer of vapor forms on the surface of the strip which limits heat exchange between the cooling liquid and the strip.

As these strips with superior mechanical properties are often used to create structural parts, the strips are often thick and can measure 2 mm thickness or more.

The difficulty is therefore being able to very rapidly cool relatively thick strips whilst ensuring high flexibility and easy operation of the line, in order to be able to produce other types of steel not requiring the same cooling speeds in the same facility. In addition to flexibility criteria, it is also important that the cooling is uniform to ensure uniform mechanical and metallurgical properties across the strip.

There are two major types of technology to cool steel strips on a continuous line: gas cooling and water cooling.

Gas cooling cannot reach these cooling rates. Indeed, even with a very high hydrogen content and very high blowing speeds, this technology is limited to around 100° C./s for a 2 mm thick strip.

Within water cooling, there are three types of technology:

- Cooling by spraying a water mist through dual fluid nozzles which spray a mixture of gas and water on the strip,
- Cooling by spraying water through single fluid nozzles which only spray water on the strip.
- Soaking through immersion in water contained in a tank, with or without agitation.

Cooling by spraying a water mist through dual fluid nozzles is very flexible but offers limited performance. The maximum performance is capped at around 500° C./s for a 2 mm thick strip with standard water pressure at around 5 bars. This cooling speed is also low when the strip is above the Leidenfrost temperature. The advantage of this technology is that it is very flexible. By adjusting gas and water pressures, it is possible to cover the entire cooling range, up to the maximum value.

Cooling by spraying water through single fluid nozzles generally has the same features. The cooling limit is also around 500° C./s with the usual pressure range, i.e. around 5 bars. The major difference is that this cooling method is less flexible, particularly for low cooling speeds. To work successfully, the nozzle water pressure cannot fall below a certain value, around 0.5 bars. At this pressure, the cooling is already above 100° C./s for a 2 mm thick strip. Therefore this technology is not able to offer slow cooling with speeds comparable to gas cooling.

Cooling through immersion in a tank can, with certain agitation conditions, reach a cooling performance around 1000° C./s for 2 mm thick strips. However the main drawback of this technology is its lack of flexibility. Indeed, once the strip has entered the water tank, it is very difficult to control the cooling speed and the final temperature of the strip. It is possible to adjust tank agitation, water temperature or the length of the immersed strip, but this has a moderate effect on the strip cooling speed. Furthermore, it is not possible to transversely adjust cooling. In addition, this technology requires the use of a costly immersed roller. Finally, for strips requiring slow cooling, the tank must be drained or bypassed, which is quite a significant process.

The invention can be used to cool a 2 mm thick strip at a wide range of cooling speeds up to 1000° C./s in a temperature range of 800-500° C., allowing transversal adjustment of the cooling efficiency for uniformity across the strip.

One proposed aspect of the invention is a rapid cooling section of a continuous metal strip treatment line, arranged to cool the strip with a spray of either a liquid or a mixture of gas and liquid using nozzles located on each side of the strip in relation to its plan of movement. Along the direction of movement of the strip, the cooling section includes at least one row of flat spray nozzles, followed by at least one row of cone spray nozzles, with the nozzle rows arranged transversely in relation to the strip's plan of movement.

As an advantage, in the direction of movement of the strip, at least one row of flat sprays can be single fluid.

At least one row of cone sprays can be single fluid.

The rapid cooling section can also include at least one row of dual fluid spray nozzles, followed by at least one row of cone spray nozzles in the direction of movement. The row of nozzles can be arranged transversely in relation to the direction of movement of the strip.

The single fluid nozzles can be arranged to spray a liquid on the strip.

The dual fluid nozzles can be arranged to spray a mist composed of a mixture of gas and liquid on the strip.

Based on the assembly method, the invention's cooling section is arranged so that the strip moves vertically from the bottom to the top.

Upstream from the row of flat spray nozzles in the direction of movement of the strip, the cooling section can include another row of flat spray nozzles where the sprays are inclined longitudinally in relation to the transversal plane and perpendicular to the strip with an angle B greater than 15°.

As an advantage, upstream from the other flat spray nozzles in the direction of movement of the strip, the cooling section can also include a further row of flat spray nozzles where the sprays are inclined longitudinally by angle C in relation to the transversal plane and perpendicular to the strip with angle C greater than angle B.

The flat spray nozzles, and more specifically those from the row and/or other row and/or further row can be inclined transversely in relation to the transversal plane and perpendicular to the strip so that the flat sprays are inclined by angle A in relation to the plane, greater than 5° and lower than 15°.

The invention also includes a feature where the liquid or mixture of gas and a liquid do not oxidize the strip.

As a preference, in the direction of movement of the strip, the cooling section does not have cone spray nozzles located upstream from the flat spray nozzles.

As a preference, in the direction of movement of the strip, each of the cone spray nozzles in the invention's cooling section is located downstream from each of the flat spray nozzles.

As a preference, in the direction of movement of the strip, the cooling section does not have flat spray nozzles downstream from the cone spray nozzles.

As a preference, in the direction of movement of the strip, each of the flat spray nozzles in the invention's cooling section is located upstream from each of the cone spray nozzles.

Another proposed aspect of the invention is a rapid cooling process of a continuous metal strip treatment line, arranged to cool the strip either with a spray of liquid or a mixture of gas and liquid using nozzles located on each side of the strip in relation to its plan of movement. Along the direction of movement of the strip, the cooling process includes at least a spray from a row of flat spray nozzles, followed by at least a spray from a row of cone spray nozzles, with the nozzle rows arranged transversely in relation to the plan of movement of the strip.

As a preference, on the longitudinal section of the strip, there is no spray from a row of cone spray nozzles before the spray from a row of flat spray nozzles.

As a preference, on the longitudinal section of the strip, there is no spray from a row of flat spray nozzles after the spray from a row of cone spray nozzles.

The invention includes ultra-rapid cooling of a 2 mm thick strip at over 1000° C./s between 800 and 500° C. in two successive stages: Firstly the strip passes in front of the first rows of single fluid flat spray nozzles, supplied by high pressure water at around 10 bars. These flat spray nozzles impact the strip precisely and firmly, therefore ensuring rapid cooling. As these nozzles hit the strip precisely, i.e. in a small section of the strip's surface, a strong flow of water is required to cover the targeted strip surface and therefore high energy consumption by the water pumps.

Once the Leidenfrost temperature has been reached, it is easier to cool the strip. This is why the cooling continues with single fluid cone spray nozzles generally at the same pressure. Cone spray nozzles are prioritized from this intermediate temperature to ensure improved distribution and water coverage of the strip. In addition, the cone spray nozzles are more efficient in terms of performance/water flow, particularly when the strip is at a lower temperature; they help reduce the water flow and therefore energy consumption by the water pumps.

The strip cooling speed can be maintained constantly along the invention's rapid cooling section with an identical cooling rate with the flat spray nozzles and the cone spray nozzles, or it can be different depending on the type of steel and desired mechanical properties.

Once the strip temperature falls to 500° C. or less, cooling to ambient temperature or the desired intermediate temperature can take place by spraying a water mist using dual fluid nozzles which spray a mixture of gas and water on the strip. This combination of cooling methods ensures total flexibility.

For thinner strips which require ultra-rapid cooling, we just need to adapt the speed of the line and/or pressure of the water in the flat spray and cone spray single fluid nozzles.

For strips requiring slow cooling, it will be possible to turn off the flat spray single fluid nozzles and the cone spray single fluid nozzles and only use the dual fluid nozzles which spray a mixture of gas and water. As the cooling zone containing the flat spray single fluid nozzles and cone spray single fluid nozzles is short (1 to 2 meters maximum), it is entirely possible to turn off this section and to complete the entire cooling process with the dual fluid nozzles spraying a mixture of gas and water.

The nozzles according to the invention are selective nozzles, covering only part of the strip width. It is therefore possible to obtain a transversal fine adjustment of cooling, which is not possible when cooling uses nozzles covering the entire width of the strip or a significant width, for example half strip width. For narrow strips, the use of selective nozzles also allows us to stop those which exceed the strip width, limiting the spray flow and the pump's electrical consumption.

Between two successive rows, the nozzles are ideally positioned in rows staggered transversely to increase cooling uniformity. In addition, the staggering between the nozzles is offset on each side of the strip to avoid having two nozzles opposite each other.

For a strip moving from the bottom to the top, it will be important to add a water knife system upstream from the first single fluid flat spray nozzles so that cooling starts clearly and is not affected by water runoff from the nozzles located above. Runoff will cause slow and non-uniform cooling before the strip approaches the first nozzles. This could lead to reduced mechanical and metallurgical properties for the strip. For strips moving from the top to the bottom, it is ideal to place a water knife system after the last row of nozzles at the cooling section exit in order to stop cooling clearly and avoid water runoff.

BRIEF DESCRIPTION OF THE DRAWINGS

The invention consists, besides the arrangements described above, of a certain number of other arrangements which will be more explicitly addressed hereafter, with reference to an assembly example described in relation to the attached drawings, but which is in no way limiting. On these drawings.

DETAILED DESCRIPTION OF THE INVENTION

This assembly method being in no way limiting, there may in particular be various embodiment of the invention that only include a selection of the characteristics described below, as described or generalized, isolated from the other characteristics described, if this selection of characteristics is sufficient to confer a technical advantage or to differentiate the invention from the state of the art.

Figure 1:
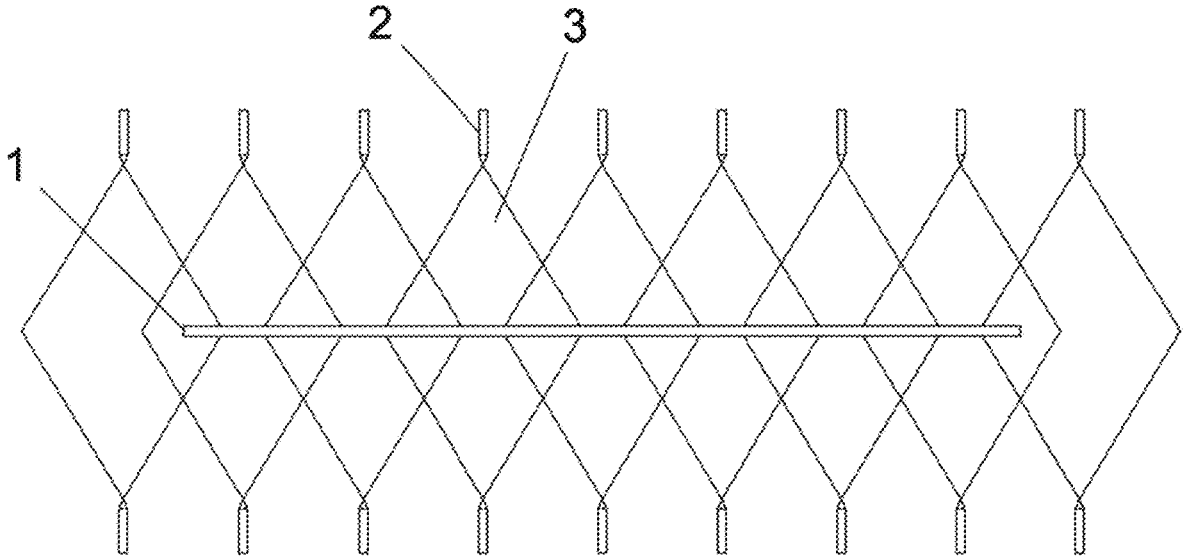
FIG. 1 is a schematic cross-section of the strip in the cooling section as per one assembly example of the invention.

The diagram in FIG. 1 of the attached drawings provides a schematic cross-section of a strip 1 during cooling with the spray of a liquid through nozzles 2 located on each side of the strip, as per one assembly example of the invention. To make it easier to understand the drawings, we have only included a small number of nozzles across the strip. The transversal pitch between the nozzles and the distance between the nozzles and the strip are adjusted based on the spray opening angle 3 to cover the entire surface of the strip and to obtain uniform transversal cooling. As we can see in this diagram, we have transversal spray cover across the strip. The cover is limited to what is needed to ensure that the entire strip is well covered by the sprays whilst ensuring uniform transversal cooling of the strip.

Figure 2:
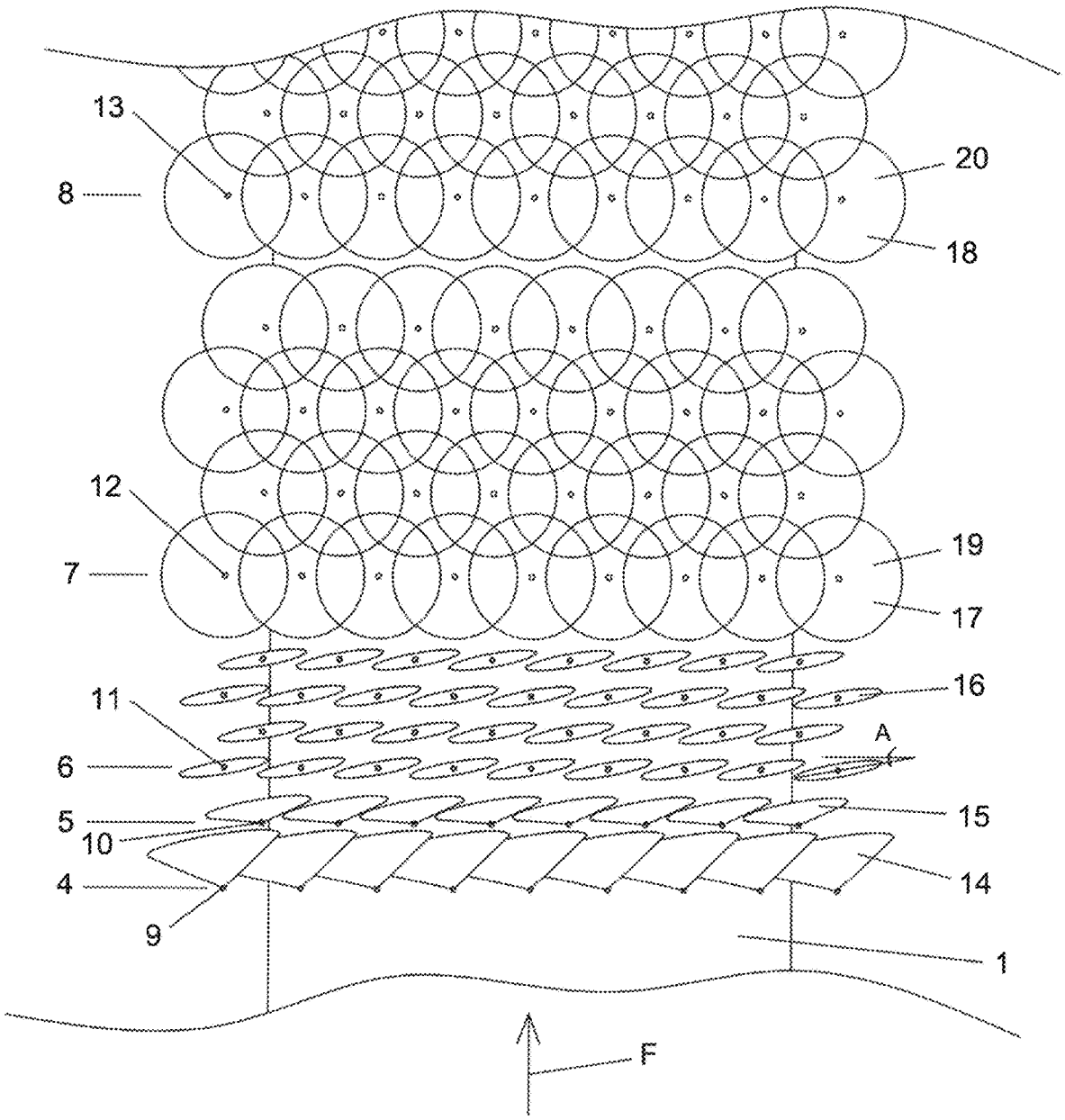
FIG. 2 is a schematic longitudinal section of the strip in the cooling section as per one assembly example of the invention in FIG. 1, and, FIG. 3 is a schematic longitudinal representation of the cooling section as per one assembly example of the invention in FIGS. 1 and 2.

The diagram in FIG. 2 of the attached drawings provides a longitudinal schematic representation of a side of a portion of strip 1 moving through a cooling section through spraying a liquid as per one assembly example of the invention. In this example, the strip moves from the bottom to the top. By entering the cooling section, the strip firstly passes by the two rows 4, 5 of nozzles 9, 10 with flat sprays 14, 15 at a high flow speed, the function of which is to remove the liquid on the strip due to runoff. This is due to some liquid sprayed on the strip by the nozzles located above these two rows 4, 5 of flat sprays running along the strip. This liquid on the strip must be removed as it would limit the effect on the strip of the rows of cooling nozzle sprays located downstream in cooling direction F. In addition, the liquid on the strip caused by runoff would lead to the strip starting to cool before it reaches the first row of nozzles. There would therefore be a less intense cooling whereas it is often necessary that it is very rapid, notably to avoid the formation of metallurgical phases with poorer mechanical properties, such as perlite, at the start of cooling. In the cooling sections where the strip moves from the top to the bottom, these rows of nozzles are not needed as the strip is not covered in liquid as it enters the cooling section. These two rows of flat sprays are inclined longitudinally in the direction of movement of the strip in relation to a transversal plane and perpendicular to the strip. The inclination angle of the first row 4 of flat sprays 14 is higher than the second row 5 to encourage the liquid to be removed from the strip. As an example, the second row 5 of flat sprays is inclined at angle B of 15° and the first row is inclined at angle C of 45°.

In the direction of movement of the strip F, the strip then moves past four successive rows 6 of flat sprays 16. These sprays ensure rapid cooling of the strip. They are perpendicular to the surface of the strip and inclined slightly transversely in relation to the transversal plane and perpendicular to the strip at angle A to limit the interaction between the sprays whilst ensuring that the entire width of the strip is covered by the sprays. This inclination angle is limited to avoid increasing the number of nozzles across the width of the strip and to avoid increasing the transversal distance between two rows of nozzles needed to avoid interaction between the sprays of these two rows. This inclination angle is between 5° and 15° and is ideally at 8°. The number of successive rows 6 of nozzles 11 with flat sprays 16 depends on the desired strip cooling profile, the characteristics of the strip, notably its maximum thickness, the maximum speed of the strip movement and the characteristics of the sprays, notably the flow and speed of the liquid.

The strip then passes by four successive rows 7 of cone sprays 17. These sprays are perpendicular to the surface of the strip. Again, the number of successive rows 7 of nozzles 12 with flat sprays 17 depends on the desired strip cooling profile, the characteristics of the strip, the maximum speed of the strip movement and the characteristics of the sprays.

In addition, the density of sprays on the surface of the strip, notably the distance between the rows 7 of nozzles in the longitudinal direction of the strip, is determined based on the desired strip cooling profile and spray heat exchange performance.

The nozzle supply pressure and the cooling fluid temperature are parameters which can be adjusted to obtain the desired cooling rate. These parameters can be kept constant along the cooling section or they can be variable, depending on the desired thermal objective. The supply pressure of nozzles 9, 10 can be higher to encourage removal of the runoff water.

The distance between the strip and the nozzles is defined by taking into consideration several parameters, notably spray characteristics, strip fluttering and the access needed for maintenance. This distance is, for example, between 150 and 300 mm. It is clearly taken into consideration to define the pitch between the nozzles and the nozzle supply pressure.

Figure 3:
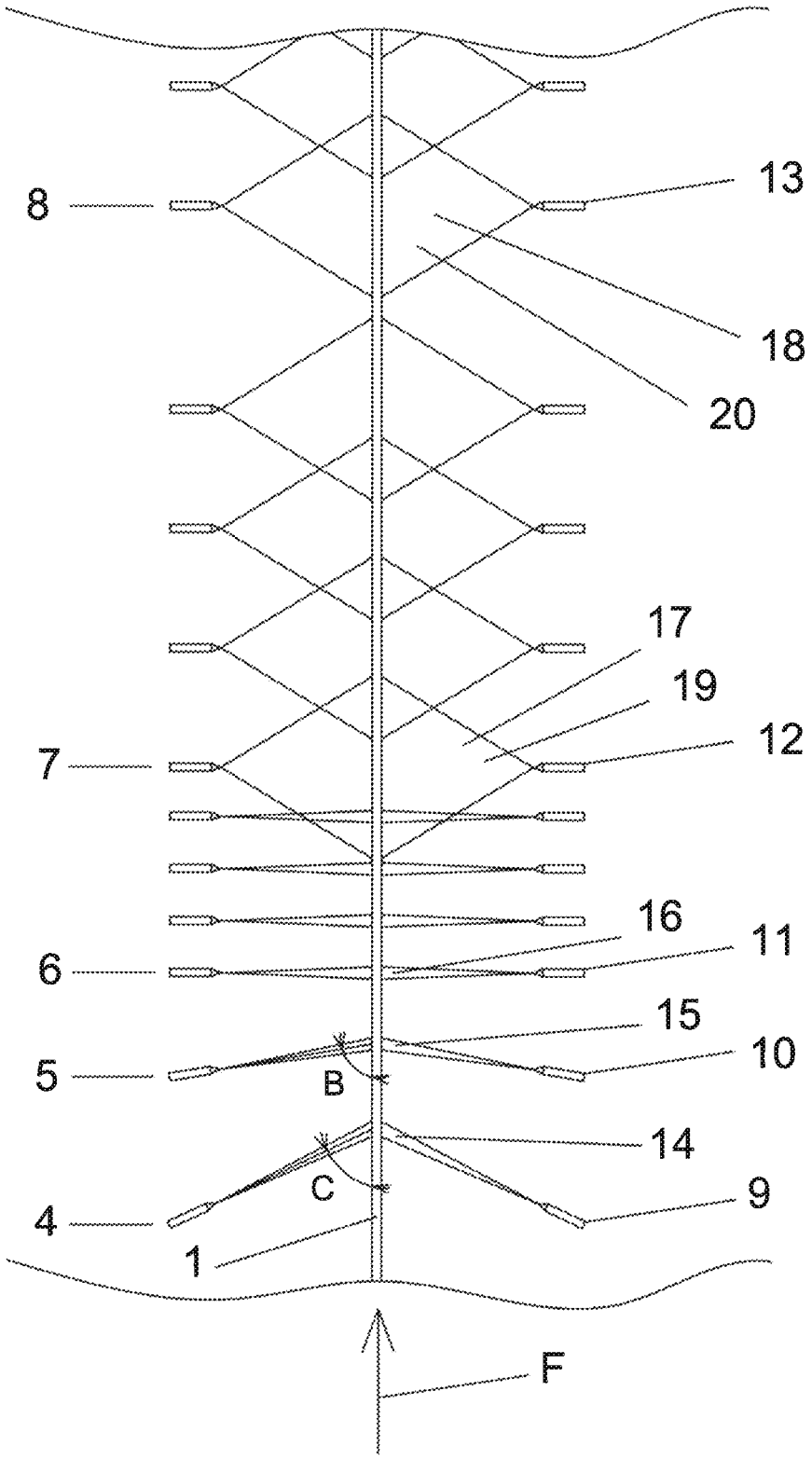

The diagram in FIG. 3 of the attached drawings provides a longitudinal and lateral schematic representation of a portion of the strip 1 moving in the cooling section represented in FIG. 2. This figure more clearly shows the longitudinal inclination of the two first rows of nozzles in the direction of movement of the strip F, the other nozzles being perpendicular to the strip.

Here we describe an assembly example of the invention for a strip moving from the bottom to the top in a rapid cooling section. The ultra-rapid cooling of a this strip at over 1000° C./s between 800 and 500° C. takes place in two successive stages: Firstly the strip passes in front of the rows 6 of single fluid nozzles 11 with flat spray 16, supplied by high pressure water 19 at around 10 bars. From a temperature of around 500° C., the strip cooling continues with nozzles 12 with cone spray 17 at the same pressure. Once the strip temperature falls to 300° C., cooling to ambient temperature or the desired intermediate temperature can take place by spraying a water mist using rows 8 of dual fluid nozzles 13 with cone sprays 18 which spray a mixture 20 of gas (e.g. nitrogen) and water on the strip. This combination of cooling methods ensures total flexibility.

- for thinner strips which require ultra-rapid cooling, we just need to adapt the speed of the line and/or pressure of the water in the flat spray and cone spray single fluid nozzles.
- for strips requiring slow cooling, it will be possible to stop the flat spray single fluid nozzles and the cone spray single fluid nozzles and only use the dual fluid nozzles spraying a mixture of gas and liquid. Indeed, the cooling zone containing flat spray single fluid nozzles and cone spray single fluid nozzles is short (1 to 2 meters maximum) so it is entirely possible to stop this section and complete the entire cooling process with the dual fluid nozzles spraying a mixture of gas and liquid.

In the assembly example represented in FIGS. 2 and 3, the dual fluid nozzles are selective and cone sprays are used. As the cooling conditions are less critical for less rapid cooling obtained by these dual fluid nozzles, slit nozzles covering the entire width of the strip or a part of it could also be used.

In this assembly example with a strip moving from the bottom to the top, it is important to add a water knife system upstream from the first single fluid flat spray nozzles so that cooling starts clearly and is not affected by water runoff from the nozzles located above. Runoff will cause slow and non-uniform cooling before the strip approaches the first nozzles. This could lead to reduced mechanical and metallurgical properties for the strip. The flat sprays 14, 15 of the water knife system are slightly transversely inclined to limit the interaction between the sprays whilst ensuring that the entire width of the strip is covered by the sprays.

This water knife system is not vital for strips moving from the top to the bottom. However, for these strips it is ideal to place a water knife system after the last row of nozzles leaving the cooling section in order to stop cooling clearly and avoid water runoff.

For our invention assembly example for the cooling of a strip moving from the bottom to the top, the cooling system is presented in the following manner:

Two rows 4, 5 of single fluid nozzles 9, 10 with flat sprays 14, 15 serving the water knives, Four rows 6 of single fluid nozzles 11 with flat sprays 16, Four rows 7 of single fluid nozzles 12 with cone sprays 17, More specifically, the pitch between each row, the pitch between each nozzle in the same row and the different angles are presented in the following table:

| Rows of nozzles from the strip entry | Type | Longitudinal distance from the first row of nozzles | Transversal inclination of sprays | Transversal inclination of sprays in relation to a plane perpendicular to the strip | Transversal distance between nozzles in the same row |
|---|---|---|---|---|---|
| 1 | Single fluid flat spray water knife | 0 mm | 8° | 50° | 100 mm |
| 2 | Single fluid flat spray water knife | 75 mm | 8° | 30° | 100 mm |
| 3 | Single fluid flat sprays | 130 mm | 8° | 0° | 100 mm |
| 4 | Single fluid flat sprays | 180 mm | 8° | 0° | 100 mm |
| 5 | Single fluid flat sprays | 230 mm | 8° | 0° | 100 mm |
| 6 | Single fluid flat sprays | 280 mm | 8° | 0° | 100 mm |
| 7 | Single fluid cone sprays | 355 mm | NA | 0° | 100 mm |
| 8 | Single fluid cone sprays | 480 mm | NA | 0° | 100 mm |
| 9 | Single fluid cone sprays | 605 mm | NA | 0° | 100 mm |
| 10 | Single fluid cone sprays | 730 mm | NA | 0° | 100 mm |

On this table, the longitudinal distance from the first row of nozzles is taken at the median axis of impact of the spray on the strip. The distance between the nozzles and the strip is 250 mm for all nozzles.

With this configuration, with water as the cooling fluid, it is possible to reach the following cooling rate between 800 and 500° C.:

for a 2 mm thick strip moving at a speed between 90 and 130 m/min, with 10 bar pressure supplied to the nozzles: 1400° C./s.

for a 1 mm thick strip moving at a speed of 240 m/min, with 10 bar pressure supplied to the nozzles: 1500° C./s.

for a 1 mm thick strip moving at a speed of 240 m/min, with 7 bar pressure supplied to the nozzles: 1300° C./s.

Of course, the invention is not limited to the examples described above and numerous adjustments can be made to these examples without moving outside the frame of the invention. Moreover, the invention's various characteristics, forms, variants and assembly methods can be linked to one another in different combinations to the extent that they remain compatible and do not exclude each other.

The invention claimed is:

1. A method of rapidly cooling a continuous metal strip treatment line, comprising:

cooling the strip with a spray of liquid or a mixture of gas and liquid using nozzles located on each side of the strip in relation to its plane of movement;

wherein along the direction of movement of the strip, the method comprises at least a spray from a row of flat spray nozzles, followed by at least a spray from a row of cone spray nozzles, with the nozzle rows arranged transversely in relation to the plane of movement of the strip; and wherein in the direction of movement of the strip, at least one row of flat spray nozzles which are single fluid, at least one row of cone spray nozzles which are single fluid, the rapid cooling section further including at least one row of flat spray nozzles which are dual fluid and followed by, in the direction of movement of the strip at least one row of cone spray nozzles which are dual fluid, the row of nozzles located transversely to the plane of movement of the strip, the single fluid nozzles arranged to spray a liquid on the strip and the dual fluid nozzles arranged to spray a mist made up of a mixture of gas and liquid on the strip.

2. The method according to claim 1, further comprising moving the strip vertically from a bottom to a top, wherein, upstream from the row of flat spray nozzles in the direction of movement of the strip, inclining a row of other flat spray nozzles longitudinally in relation to a transversal plane and perpendicular to the strip with angle B greater than 15°.

3. The method according to claim 2, wherein upstream from the other flat spray nozzles in the direction of movement of the strip, inclining a row of flat spray nozzles longitudinally by angle C in relation to the transversal plane and perpendicular to the strip with angle C being greater than angle B.

4. The method according to claim 1, wherein the at least one row of flat spray nozzles are inclined transversely in relation to the transversal plane and perpendicular to the strip so that the flat sprays are inclined by angle A in relation to the plane greater than 5° and lower than 15°.

5. The method according to claim 1, wherein the liquid or mixture of gas and a liquid do not oxidize the strip.

6. The method according to claim 1, wherein the strip is passed by the flat spray nozzles at a high flow rate.

7. A rapid cooling section of a treatment line for a continuous metal strip, comprising:

nozzles located on each side of the strip in relation to its plane of movement, wherein the nozzles are arranged to cool the strip with a spray of liquid or a mixture of gas and liquid;

wherein, along a direction of movement of the strip the nozzles comprise at least one row of flat spray nozzles, followed by at least one row of cone spray nozzles, wherein the nozzle rows are arranged transversely in relation the plane of movement of the strip; and wherein in the direction of movement of the strip, at least one row of flat spray nozzles which are single fluid, at least one row of cone spray nozzles which are single fluid, the rapid cooling section further including at least one row of flat spray nozzles which are dual fluid and followed by, in the direction of movement of the strip at least one row of cone spray nozzles which are dual fluid, the row of nozzles located transversely to the plane of movement of the strip, the single fluid nozzles arranged to spray a liquid on the strip and the dual fluid nozzles arranged to spray a mist made up of a mixture of gas and liquid on the strip.

8. The rapid cooling section according to claim 7, arranged so that the strip moves vertically from a bottom to a top, including, upstream from the row of flat spray nozzles in the direction of movement of the strip, a row of other flat spray nozzles where the other flat spray nozzles are inclined longitudinally in relation to a transversal plane and perpendicular to the strip with angle B greater than 15°.

9. The rapid cooling section according to claim 8, further comprising upstream from the other flat spray nozzles in the direction of movement of the strip, a row of flat spray nozzles wherein the flat spray nozzles are inclined longitudinally by angle C in relation to the transversal plane and perpendicular to the strip with angle C greater than angle B.

10. The rapid cooling section according to claim 7, wherein the flat spray nozzles are inclined transversely in relation to the transversal plane and perpendicular to the strip so that the flat sprays are inclined by angle A in relation to the plane greater than 5° and lower than 15°.

11. The rapid cooling section according to claim 7, wherein the liquid or mixture of gas and a liquid do not oxidize the strip.

12. The rapid cooling section according to claim 7, wherein the strip is passed by the flat spray nozzles at a high flow rate.

* * * * *